US010289028B2

(12) United States Patent
Nishiyama

(10) Patent No.: US 10,289,028 B2
(45) Date of Patent: May 14, 2019

(54) DEVELOPING APPARATUS HAVING OPENING AND SHUTTER

(71) Applicant: BROTHER KOGYO KABUSHIKI KAISHA, Nagoya-shi, Aichi-ken (JP)

(72) Inventor: Hideshi Nishiyama, Owariasahi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/189,106

(22) Filed: Nov. 13, 2018

(65) Prior Publication Data

US 2019/0086836 A1 Mar. 21, 2019

Related U.S. Application Data

(63) Continuation of application No. 15/473,408, filed on Mar. 29, 2017, now Pat. No. 10,133,212.

(30) Foreign Application Priority Data

Aug. 26, 2016 (JP) ..... 2016-166077

(51) Int. Cl.
*G03G 15/08* (2006.01)

(52) U.S. Cl.
CPC . *G03G 15/0886* (2013.01); *G03G 2215/0692* (2013.01)

(58) Field of Classification Search
CPC ..... G03G 15/0867; G03G 15/087; G03G 15/0886; G03G 2215/067; G03G 2215/0692
USPC ..... 399/258, 262; 222/DIG. 1
See application file for complete search history.

(56) References Cited

U.S. PATENT DOCUMENTS

| | | | |
|---|---|---|---|
| 5,734,953 | A | 3/1998 | Tatsumi |
| 7,010,250 | B1 | 3/2006 | Yahagi |
| 7,539,445 | B2 | 5/2009 | Sasae |
| 8,335,455 | B2 | 12/2012 | Maeshima |
| 8,787,803 | B2 | 7/2014 | Nakasone |

(Continued)

FOREIGN PATENT DOCUMENTS

| | | | |
|---|---|---|---|
| JP | 7-181793 | A | 7/1995 |
| JP | 8-286490 | A | 11/1996 |

(Continued)

OTHER PUBLICATIONS

International Search Report and Written Opinion based on related international application PCT/JP2017/013046, dated May 23, 2017.

*Primary Examiner* — Robert B Beatty
(74) *Attorney, Agent, or Firm* — Merchant & Gould P.C.

(57) ABSTRACT

In a developing apparatus, a housing has a first opening. A shutter is movable between an open position and a closed position. A locking member is movable between a lock position and a release position. The locking member is located between the housing and the shutter in a cartridge-attachment direction. The locking member is located at the lock position in a case where the toner cartridge is detached from the developing apparatus. The locking member is in contact with the toner cartridge, thereby moving from the lock position to the release position in a case where the toner cartridge is attached to the developing apparatus. A cover having a second opening that is in communication with the first opening in a state where the shutter is at the open position is located at an opposite side of the locking member with respect to the shutter in the cartridge-attachment direction.

20 Claims, 13 Drawing Sheets

(56) References Cited

U.S. PATENT DOCUMENTS

| | | | |
|---|---|---|---|
| 8,983,343 | B2 | 3/2015 | Wakimoto |
| 2002/0034404 | A1 | 3/2002 | Kojima et al. |
| 2007/0196136 | A1 | 8/2007 | Yamamoto |
| 2007/0237551 | A1 | 10/2007 | Kawai |
| 2009/0214257 | A1 | 8/2009 | Kweon et al. |
| 2009/0297226 | A1 | 12/2009 | Nagashima |
| 2011/0103845 | A1 | 5/2011 | Sato |
| 2012/0099901 | A1 | 4/2012 | Sakai |
| 2016/0313673 | A1 | 10/2016 | Eto |
| 2017/0285528 | A1 | 10/2017 | Nishiyama |
| 2017/0285529 | A1 | 10/2017 | Nishiyama |

FOREIGN PATENT DOCUMENTS

| | | | |
|---|---|---|---|
| JP | 2001-222160 | A | 8/2001 |
| JP | 2002-072653 | A | 3/2002 |
| JP | 2005-37673 | A | 2/2005 |
| JP | 2006-195237 | A | 7/2006 |
| JP | 2008-134526 | A | 6/2008 |
| JP | 2015-138190 | A | 7/2015 |

DEVELOPING APPARATUS HAVING OPENING AND SHUTTER

CROSS REFERENCE TO RELATED APPLICATION

This application is a continuation of U.S. patent application Ser. No. 15/473,408 filed Mar. 29, 2017, which further claims priority from Japanese Patent Application No. 2016-166077 filed Aug. 26, 2016. The entire contents of both applications is incorporated herein by reference.

TECHNICAL FIELD

The present disclosure relates to a developing apparatus.

BACKGROUND

There is known a developing apparatus of a type, to and from which a toner cartridge can be attached and detached. The toner cartridge accommodates toner therein. The developing apparatus is provided with a developing roller.

For example, prior art discloses a developing apparatus that has an opening and includes a shutter and a locking member. The developing apparatus receives toner through the opening from a toner cartridge. The shutter is movable between an open position, at which the shutter opens the opening, and a closed position at which the shutter closes the opening. The locking member includes a protrusion. The shutter has a through-hole in which the protrusion is fitted. While the shutter remains at the closed position, the protrusion of the locking member is fitted in the through-hole of the shutter, whereby the locking member locks the closed state of the shutter.

In a case where the toner cartridge is attached to the developing apparatus, the toner cartridge is located at an opposite side of the housing of the developing apparatus with respect to the shutter. A protrusion provided at the toner cartridge contacts against the locking member, whereupon the protrusion of the locking member is separated away from the through-hole of the shutter. As a result, the locking member releases the locked state of the shutter. At this time, the protrusion of the toner cartridge is fitted into the through-hole of the shutter. As a result, the shutter is rotatable together with the toner cartridge. In this state, the toner cartridge is rotated relative to the developing apparatus. As a result, the shutter moves from the closed position to the open position.

SUMMARY

In the above-described conventional developing apparatus, however, as the toner cartridge is further rotated, the protrusion provided at the toner cartridge gradually moves away from the locking member. As a result, the locking member moves back to the original position, at which the locking member has locked the shutter, and ultimately contacts against a surface of the shutter that is opposite to a surface of the shutter that contacts the toner cartridge. The locking member presses both of the shutter and the toner cartridge in a direction away from the housing. Due to the pressing force applied from the locking member, gaps will possibly be generated between the shutter and the housing of the developing apparatus, and between the opening of the developing apparatus and the opening of the toner cartridge. Toner will possibly leak through these gaps.

It is therefore an object of the disclosure to provide a developing apparatus that allows the shutter to smoothly move between an open position and a closed position and that can prevent toner from being leaked.

According to one aspect, a developing apparatus, to which a toner cartridge configured to toner therein is attachable, includes: a developing roller; a housing; a shutter; a locking member; and a cover. The developing roller is rotatable about a first axis extending in a first direction. The housing is configured to accommodate toner therein. The housing has a first opening, through which toner is supplied from an inside of the toner cartridge into the housing. The shutter is movable between an open position, at which the shutter opens the first opening, and a closed position, at which the shutter closes the first opening. The locking member is movable between a lock position, at which the locking member locks the shutter at the closed position, and a release position, at which the locking member releases the locked state of the shutter. The locking member is located between the housing and the shutter in a cartridge-attachment direction, in which the toner cartridge is attached to the developing apparatus. The locking member is at the lock position in a case where the toner cartridge is detached from the developing apparatus. The locking member is in contact with the toner cartridge, thereby moving from the lock position to the release position in a case where the toner cartridge is attached to the developing apparatus. The cover has a second opening that is in communication with the first opening in a state where the shutter is at the open position. The cover is located at an opposite side of the locking member with respect to the shutter in the cartridge-attachment direction.

BRIEF DESCRIPTION OF THE DRAWINGS

The particular features and advantages of the disclosure will become apparent from the following description taken in connection with the accompanying drawings, in which.

DETAILED DESCRIPTION

Figure 1:
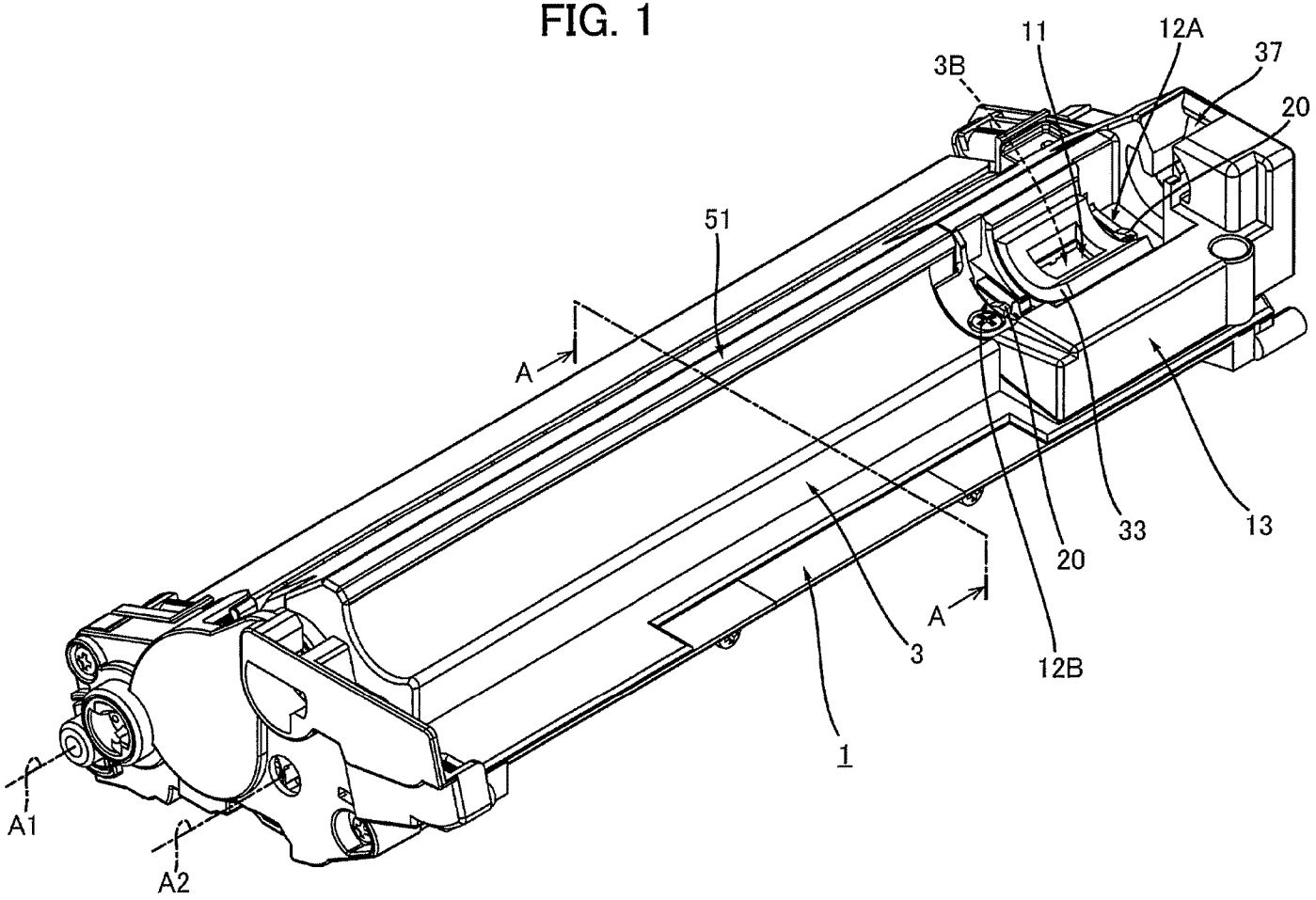
FIG. 1 is a perspective view of a developing apparatus according to an embodiment.

A developing apparatus according to an embodiment will be described while referring to the accompanying drawings wherein like parts and components are designated by the same reference numerals to avoid duplicating description.

1. Outline of the Developing Apparatus

First, a developing apparatus 1 according to an embodiment will be briefly described with reference to FIG. 1 and FIG. 2.

The developing apparatus 1 is for developing images by using toner supplied from a toner cartridge 100 (see FIG. 9) which will be describer later. To "develop images" is to apply toner to a photosensitive body, thereby changing an electrostatic latent image formed on the photosensitive body to a visible image. The toner cartridge 100 is capable of being attached to, and detached from, the developing apparatus 1. As will be detailed later, the toner cartridge 100 is attached to the developing apparatus 1 by first mounting the toner cartridge 100 onto the developing apparatus 1, and thereafter pivotally moving the toner cartridge 100 from a first position (see FIG. 10) to a second position (see FIG. 13) relative to the developing apparatus 1.

Figure 2:
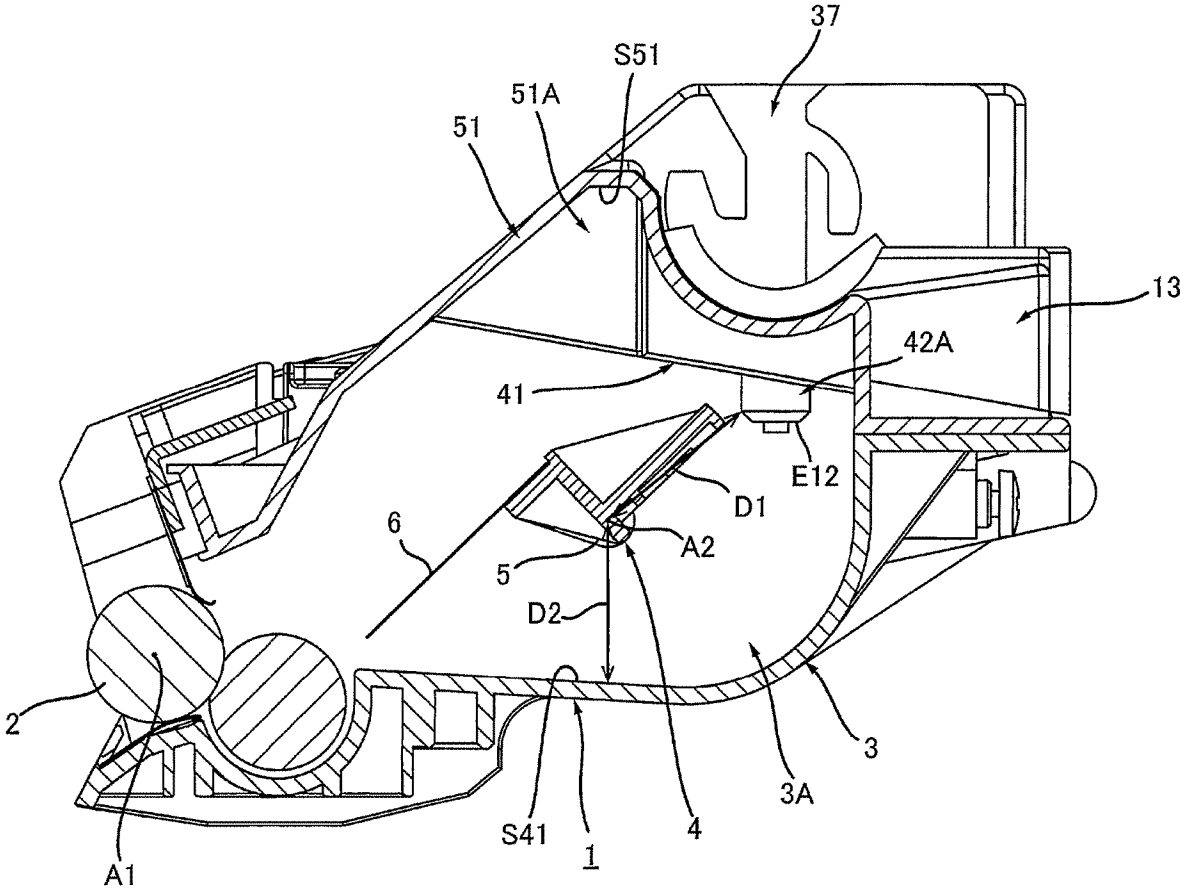
FIG. 2 is a cross-sectional view of the developing apparatus taken along a line A-A in FIG. 1.

The developing apparatus 1 includes: a housing 3; a developing roller 2 (see FIG. 2); and an agitator 4 (see FIG. 2). The developing apparatus 1 may include a photosensitive member. The developing apparatus 1 may be a cartridge-type that can be attached to, and detached from, an image forming apparatus.

1.1 Developing Roller

The developing roller 2 is rotatable about a first axis A1 that extends in a first direction. The developing roller 2 is configured to be in contact with the photosensitive body. The developing roller 2 is rotatably supported by the housing 3.

1.2 Housing

The housing 3 extends in the first direction. The housing 3 has an internal space 3A. The housing 3 is configured to accommodate, in the internal space 3A, toner supplied from the toner cartridge 100.

The housing 3 has a first opening 3B (see FIG. 1). Toner accommodated in the toner cartridge 100 is supplied through the first opening 3B into the internal space 3A of the housing 3, while the cartridge 100 remains attached to the developing apparatus 1. The first opening 3B is located at one end portion of the housing 3 in the first direction.

1.3 Agitator

The agitator 4 is located in the internal space 3A of the housing 3. The agitator 4 agitates toner that has been supplied into the internal space 3A of the housing 3 from the toner cartridge 100, and transports toner from the internal space 3A of the housing 3 to the developing roller 2. The agitator 4 is rotatable about a second axis A2 extending in the first direction. The agitator 4 includes an agitator shaft 5 and a blade 6. The agitator shaft 5 extends along the second axis A2. The blade 6 is rotatable together with the agitator shaft 5.

2. Details of the Developing Apparatus

The developing apparatus 1 will be described in greater detail below.

As shown in FIG. 1, the developing apparatus 1 further includes: a shutter 11, a locking member 12A, a locking member 12B, and a cover 13.

2.1 Shutter

Figure 3A:
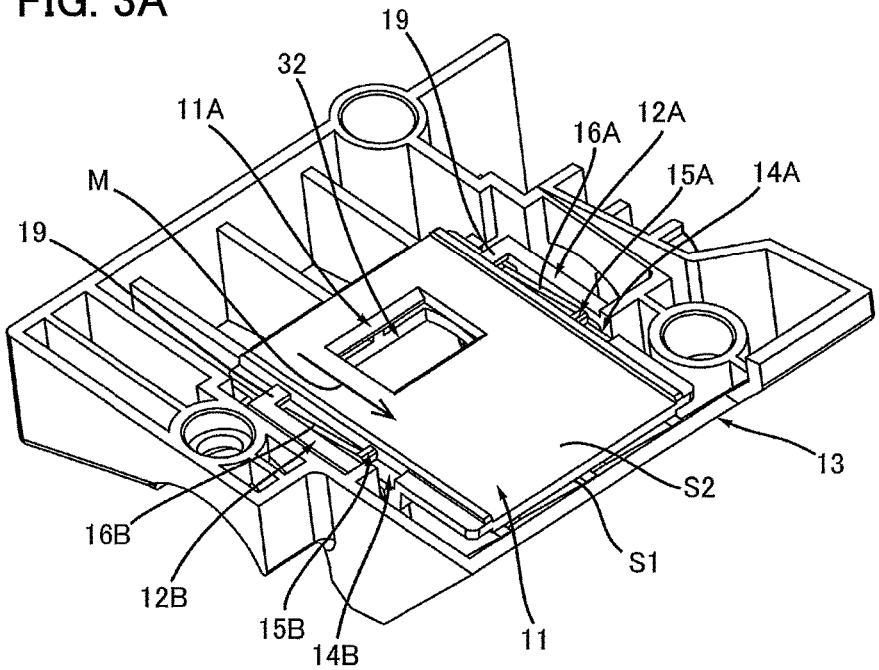
FIG. 3A is a perspective view of a cover and a shutter shown in FIG. 1, wherein the shutter is in an open position.
Figure 10:
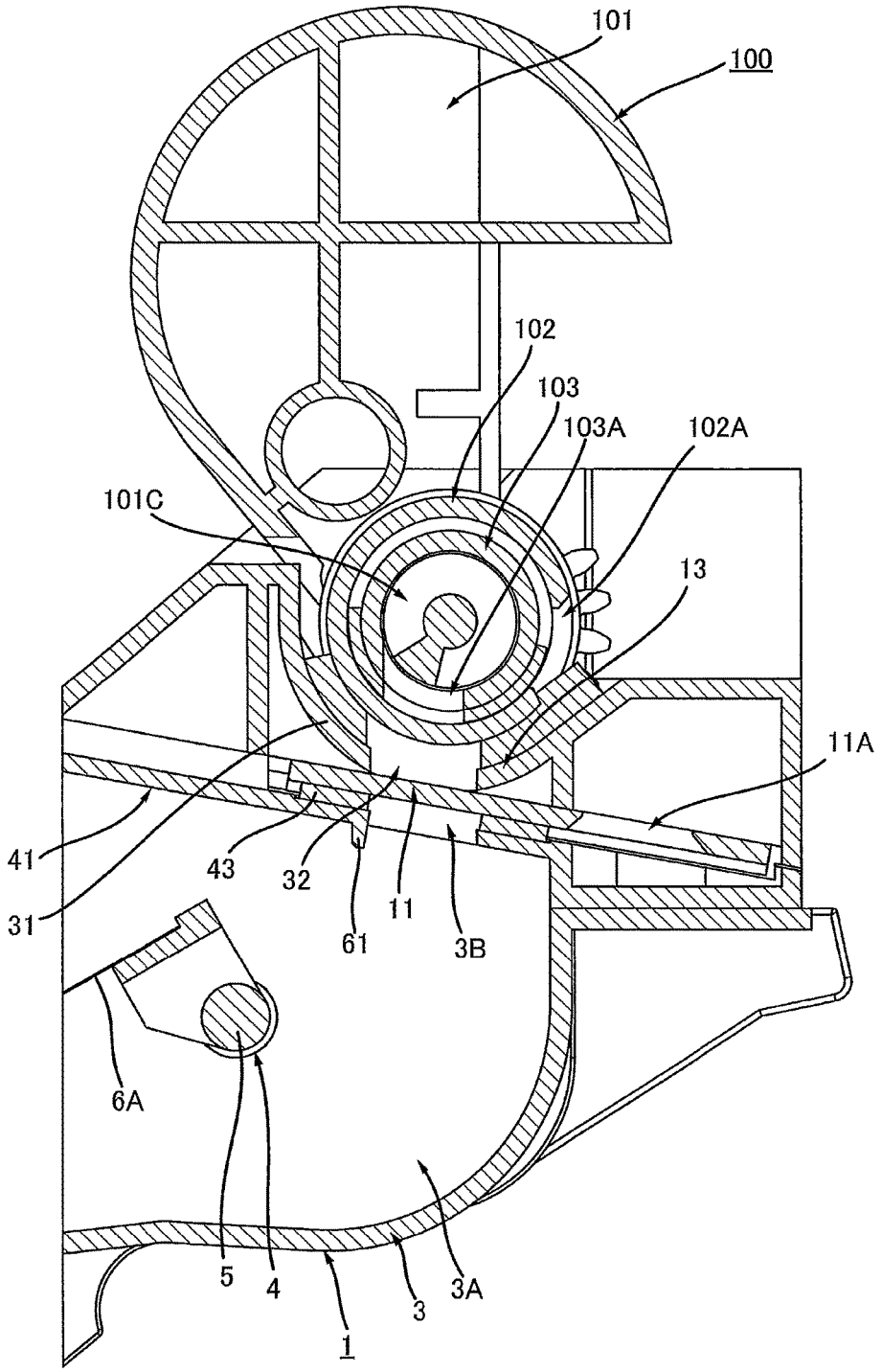
FIG. 10 is a cross-sectional view of the developing apparatus attached with the toner cartridge, corresponding to a cross-sectional view taken along a line D-D in FIG. 4, and shows a state where the toner cartridge is at a first position with respect to the developing apparatus.

The shutter 11 is for opening and closing the first opening 3B of the housing 3. As shown in FIG. 10, the shutter 11 is located between the first opening 3B and the cover 13 in a cartridge-attachment direction, in which the toner cartridge 100 is attached to the developing apparatus 1. The shutter 11 is movable between an open position (see FIG. 13), at which the shutter 11 opens the first opening 3B, and a closed position (see FIG. 10), at which the shutter 11 closes the first opening 3B. The shutter 11 is movable between the open position and the closed position in a second direction that intersects with the first direction. As shown in FIG. 3A, the shutter 11 extends both in the first direction and the second direction. The shutter 11 is in a plate shape. The shutter 11 has one end and another end that are spaced from each other in the first direction.

2.1.1 Opening of the Shutter

The shutter 11 has a shutter opening 11A. The shutter opening 11A is located at a position between the one end and the other end of the shutter 11 in the first direction. While the shutter 11 remains at the open position, at least portion of the shutter opening 11A overlaps with both of the first opening 3B of the housing 3 and a second opening 32 of the cover 13. The shutter opening 11A allows toner accommodated in the toner cartridge 100 to enter the internal space 3A of the housing 3 through the second opening 32 and the first opening 3B as long as the shutter 11 remains at the open position. While the shutter 11 remains at the closed position, no portion of the shutter opening 11A overlaps with the second opening 32 or the first opening 3B. The shutter opening 11A prevents toner accommodated in the toner cartridge 100 from entering the internal space 3A of the housing 3 through the second opening 32 and the first opening 3B as long as the shutter 11 remains at the closed position.

2.1.2 Locking Grooves and Locking Protrusions

The shutter 11 has a locking groove 14A and a locking groove 14B. Further, the shutter 11 has a locking protrusion 15A and a locking protrusion 15B.

Figure 5:
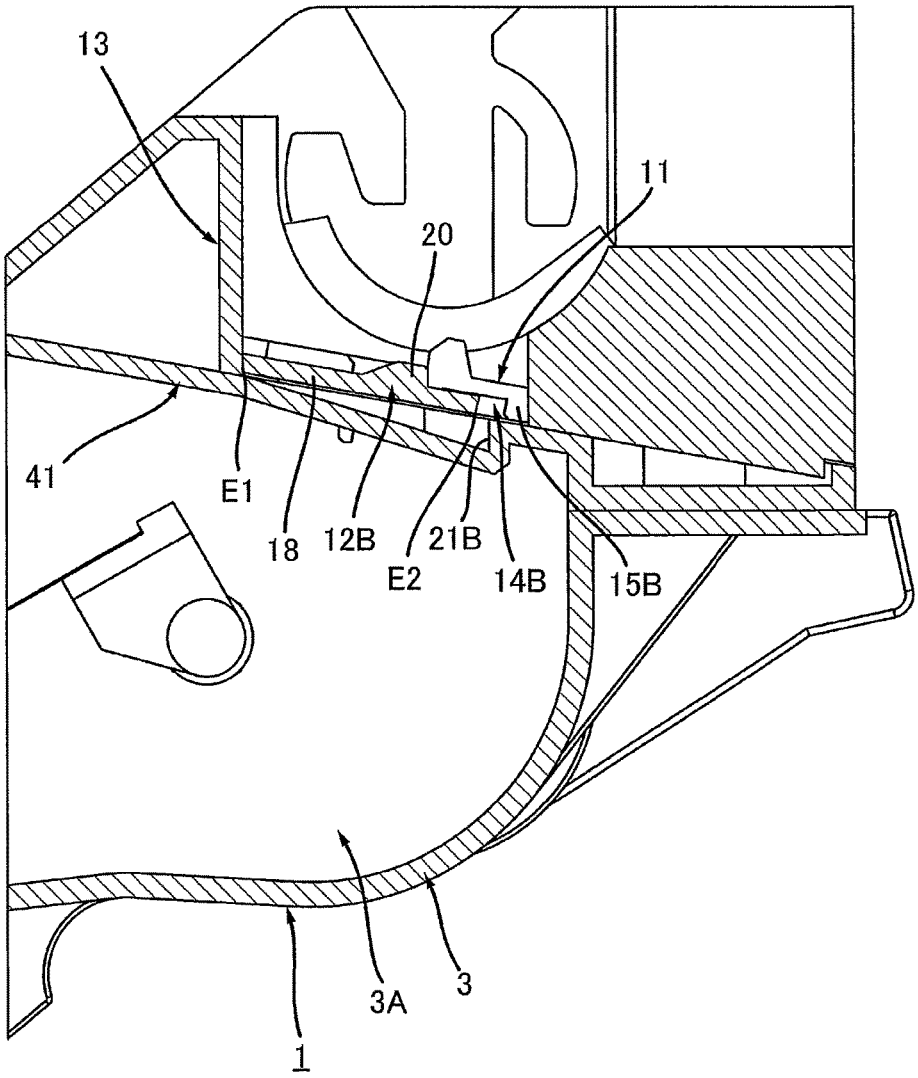
FIG. 5 is a cross-sectional view of the developing apparatus taken along a line A-A in FIG. 4.

While the toner cartridge 100 remains detached from the developing apparatus 1, in a case where the shutter 11 is at the closed position, the locking groove 14A receives a first protrusion 19 of the locking member 12A, and the locking groove 14B receives a first protrusion 19 of the locking member 12B (see FIG. 5). The locking groove 14A is located at one end of the shutter 11 in the first direction, and extends in the second direction. The locking groove 14B is located at the other end of the shutter 11 in the first direction, and extends in the second direction. The locking groove 14A is concaved in a direction that is parallel to the first direction and that is directed from the one end toward the other end of the shutter 11. The locking groove 14B is concaved in a direction that is parallel to the first direction and that is directed from the other end toward one end of the shutter 11. The shutter 11 has one surface S1 and another surface S2 opposite to each other in the cartridge-attachment direction such that the surface S1 of the shutter 11 faces the cover 13 and the surface S2 of the shutter 11 faces the housing 3. The locking groove 14A and the locking groove 14B are concaved also in a direction that is parallel to the cartridge-attachment direction and that is directed from the other surface S2 to the one surface S1.

While the toner cartridge 100 remains detached from the developing apparatus 1, the locking protrusions 15A and 15B cooperate with the locking members 12A and 12B to prevent the shutter 11 from moving from the closed position to the open position. That is, the locking protrusion 15A can prevent the shutter 11 from moving from the closed position to the open position by contacting the first protrusion 19 of the locking member 12A, and the locking protrusion 15B can prevent the shutter 11 from moving from the closed position to the open position by contacting the first protrusion 19 of the locking member 12B (see FIG. 5). The shutter 11 includes the locking protrusion 15A at a trailing side of the locking groove 14A with respect to the moving direction M of the shutter 11 (which will be referred to as "shutter-moving direction M" hereinafter), in which the shutter 11 moves from the closed position to the open position. The shutter 11 includes the locking protrusion 15B at a trailing side of the locking groove 14B with respect to the shutter-moving direction M. The locking protrusion 15A and the locking protrusion 15B protrude from the shutter 11 in a direction that is parallel to the cartridge-attachment direction and that is directed from the surface S1 toward the other surface S2 of the shutter 11. The locking protrusion 15A includes an inclined surface 16A at a trailing side of the locking protrusion 15A with respect to the shutter-moving direction M. The locking protrusion 15B includes an inclined surface 16B at a trailing side of the locking protrusion 15B with respect to the shutter-moving direction M. Each of the inclined surfaces 16A and 16B extends in the second direction. Each of the inclined surfaces 16A and 16B slopes in a direction directed from the surface S1 to the surface S2 while progressing in the shutter-moving direction M.

2.1.3 Gear Part

Figure 4:
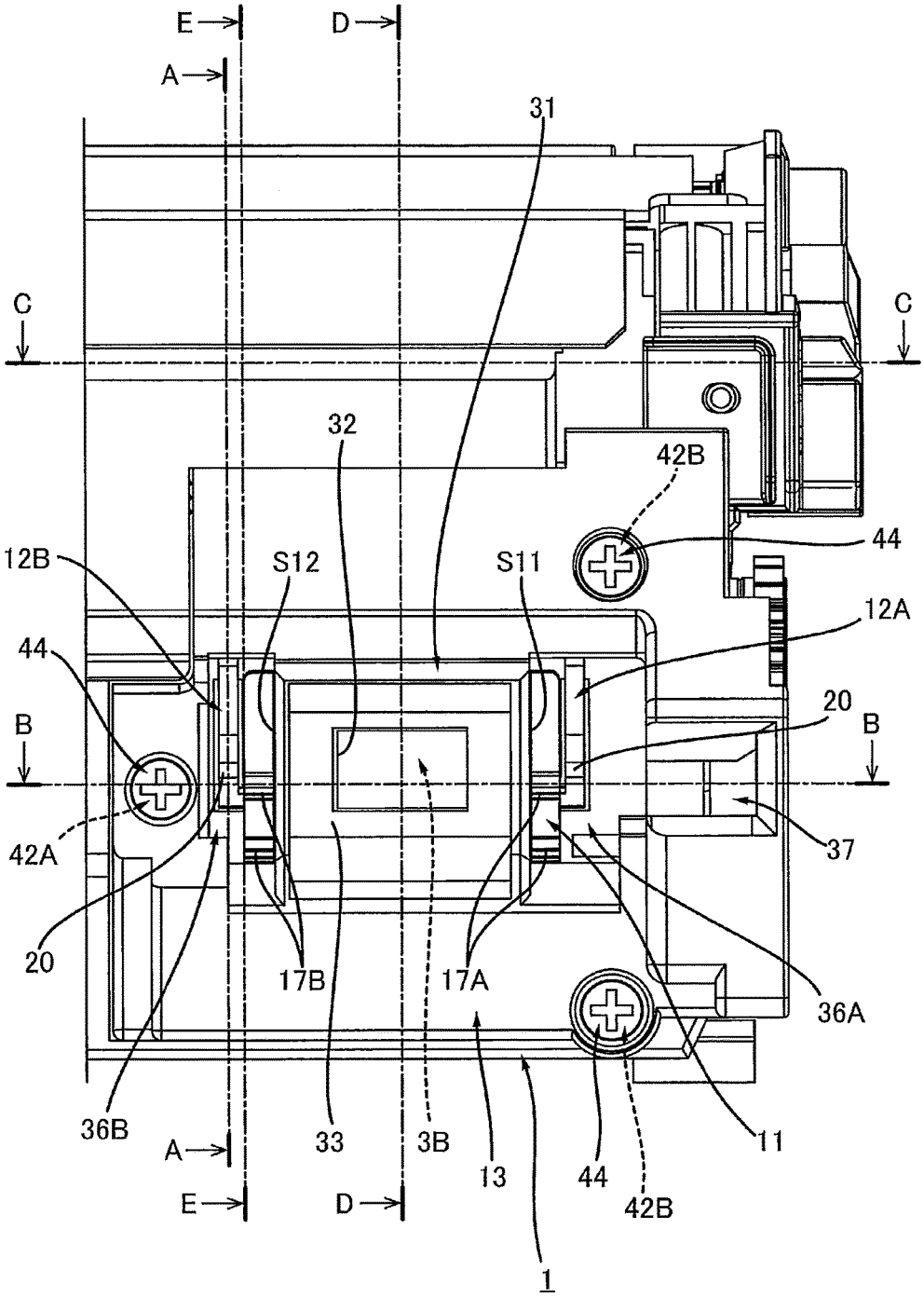
FIG. 4 is a side view of part of the developing apparatus as viewed in a cartridge-attachment direction, in which a toner cartridge is attached to the developing apparatus.
Figure 12:
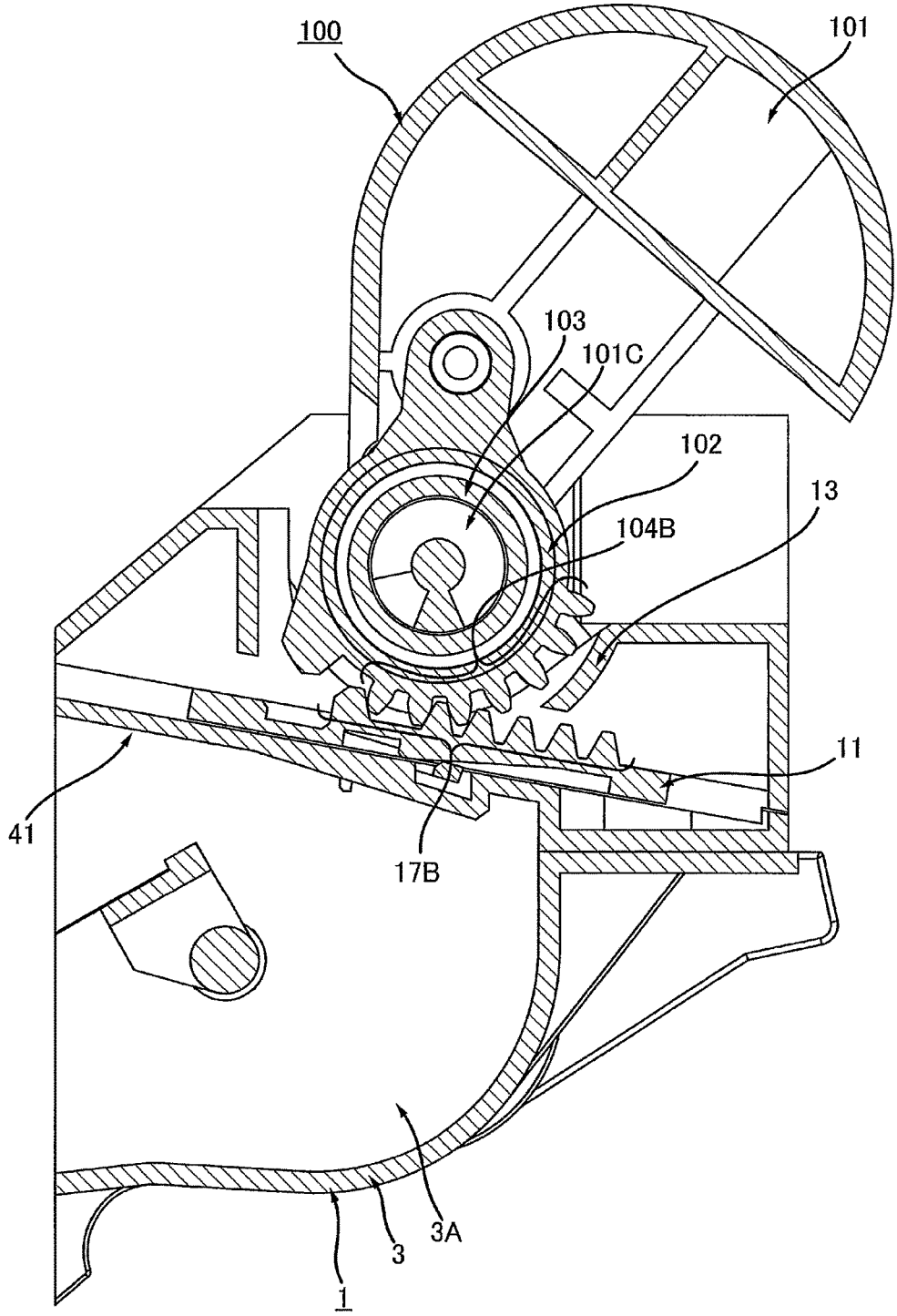
FIG. 12 is a cross-sectional view of the developing apparatus attached with the toner cartridge, corresponding to a cross-sectional view taken along a line E-E in FIG. 4, and shows a state where the toner cartridge is being pivotally moved from the first position to the second position with respect to the developing apparatus.

As shown in FIG. 4 and FIG. 12, the shutter 11 is provided with a gear part 17A and a gear part 17B.

Figure 9:
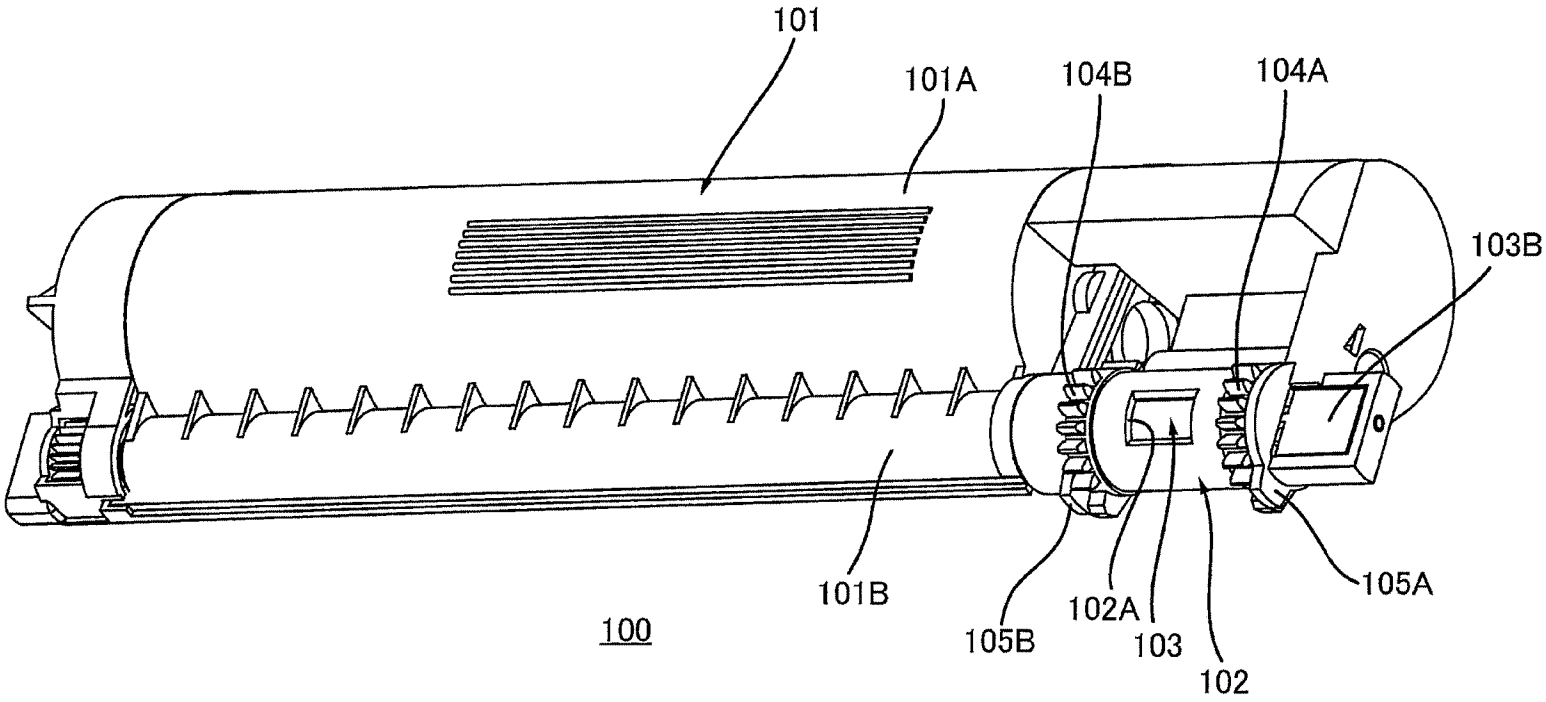
FIG. 9 is a perspective view of the toner cartridge.

When the toner cartridge 100 is attached to the developing apparatus 1, the gear part 17A is meshingly engaged with a gear part 104A provided to the toner cartridge 100 (to be described later, see FIGS. 9 and 12), and the gear part 17B is meshingly engaged with a gear part 104B provided to the toner cartridge 100 (to be described later, see FIGS. 9 and 12). The gear part 17A is located at the one end of the shutter 11 in the first direction, while the gear part 17B is located at the other end of the shutter 11 in the first direction. Each of the gear parts 17A and 17B has a plurality of gear teeth arranged in the second direction. That is, the gear teeth of each of the gear parts 17A and 17B are arranged in the shutter-moving direction M.

2.2 Locking Members

Figure 3B:
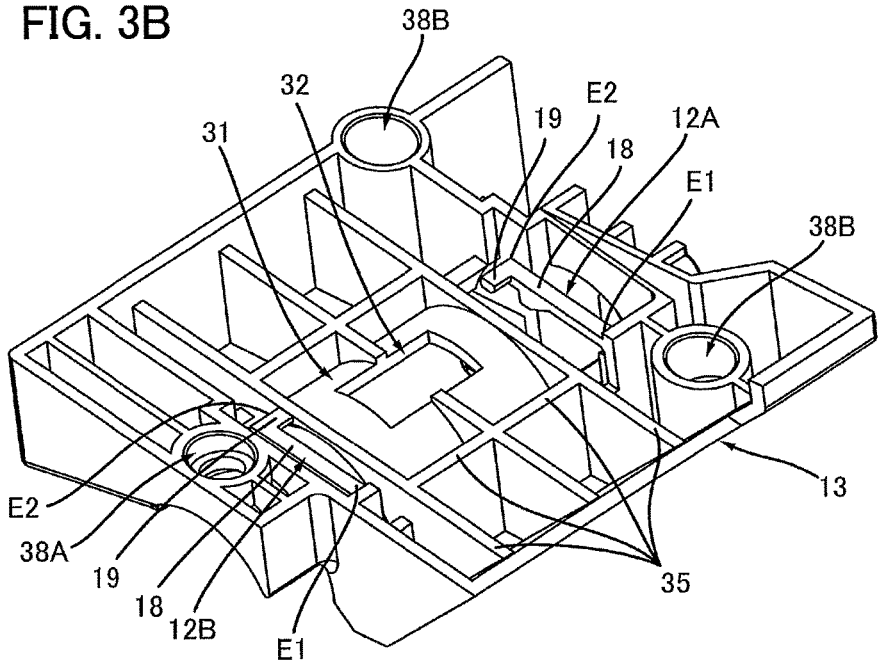
FIG. 3B is a perspective view of the cover shown in FIG. 3A, from which the shutter is removed.

As shown in FIG. 4 and FIG. 5, the locking members 12A and 12B are for locking the shutter 11 at the closed position while the toner cartridge 100 remains detached from the developing apparatus 1. To "lock the shutter 11 at the closed position" is to prevent the shutter 11 from moving from the closed position toward the open position. The locking members 12A and 12B are movable between lock positions (see FIG. 5), at which the locking members 12A and 12B lock the shutter 11 at the closed position, and release positions (see FIG. 11), at which the locking members 12A and 12B release the locked state of the shutter 11. In a case where the toner cartridge 100 is detached from the developing apparatus 1, the locking members 12A and 12B become located at the lock positions. In a case where the toner cartridge 100 is attached to the developing apparatus 1, protrusions 105A and 105B provided to the toner cartridge 100 (to be described later, see FIGS. 9 and 11) contact the locking members 12A and 12B, respectively, whereupon the locking members 12A and 12B move from the lock positions to the release positions. The locking members 12A and 12B are spaced apart from each other in the first direction. The shutter 11 is located between the locking members 12A and 12B in the first direction. Each of the locking members 12A and 12B extends in the second direction. More specifically, as shown in FIG. 3B and FIG. 5, each of the locking members 12A and 12B includes a main part 18, a first protrusion 19, and a second protrusion 20 (see FIG. 5).

The main part 18 extends in the second direction. That is, the main part 18 extends in the shutter-moving direction M. The main part 18 extends from part of the cover 13. More specifically, the main part 18 has a base end E1 and a distal end E2 spaced apart from each other in the second direction. The main part 18 is connected at the base end E1 to the part of the cover 13. The distal end E2 of the main part 18 is located upstream of the base end E1 in the shutter-moving direction M, in which the shutter 11 moves from the closed position to the open position (see FIG. 3A).

The first protrusion 19 is located at the distal end E2 of the main part 18. The first protrusion 19 protrudes from the main part 18. More specifically, the first protrusion 19 of the locking member 12A protrudes toward the locking member 12B in the first direction. The first protrusion 19 of the locking member 12B protrudes toward the locking member 12A in the first direction. The first protrusion 19 is located between the housing 3 and the shutter 11 in the cartridge-attachment direction. That is, the locking members 12A and 12B are located between the housing 3 and the shutter 11 in the cartridge-attachment direction. The first protrusion 19 of the locking member 12A is fitted in the locking groove 14A of the shutter 11 in a case where the shutter 11 is at the closed position while the toner cartridge 100 remains detached from the developing apparatus 1. Thus, the first protrusion 19 of the locking member 12A is fitted in the locking groove 14A of the shutter 11 as long as the locking member 12A stays at the lock position. The first protrusion 19 of the locking member 12B is fitted in the locking groove 14B of the shutter 11 in a case where the shutter 11 is at the closed position while the toner cartridge 100 remains detached from the developing apparatus 1. Thus, the first protrusion 19 of the locking member 12B is fitted in the locking groove 14B of the shutter 11 as long as the locking member 12B stays at the lock position. Hence, even in a case where a user tries to move the shutter 11 from the closed position to the open position while the locking members 12A and 12B remain at the lock positions, the locking protrusions 15A and 15B of the shutter 11 contact the first protrusions 19 of the locking members 12A and 12B, respectively, thereby stopping movement of the shutter 11.

The second protrusion 20 protrudes from the main part 18 in a direction that is parallel to the cartridge-attachment direction and that is directed away from the housing 3. In a case where the toner cartridge 100 is attached to the developing apparatus 1, the protrusions 105A and 105B of the toner cartridge 100 (see FIGS. 9 and 11) contact the second protrusions 20 of the locking members 12A and 12B, respectively, thereby moving the locking members 12A and 12B from the lock positions to the release positions. At this time, the main parts 18 of the locking members 12A and 12B are bent in the cartridge-attachment direction.

Figure 6:
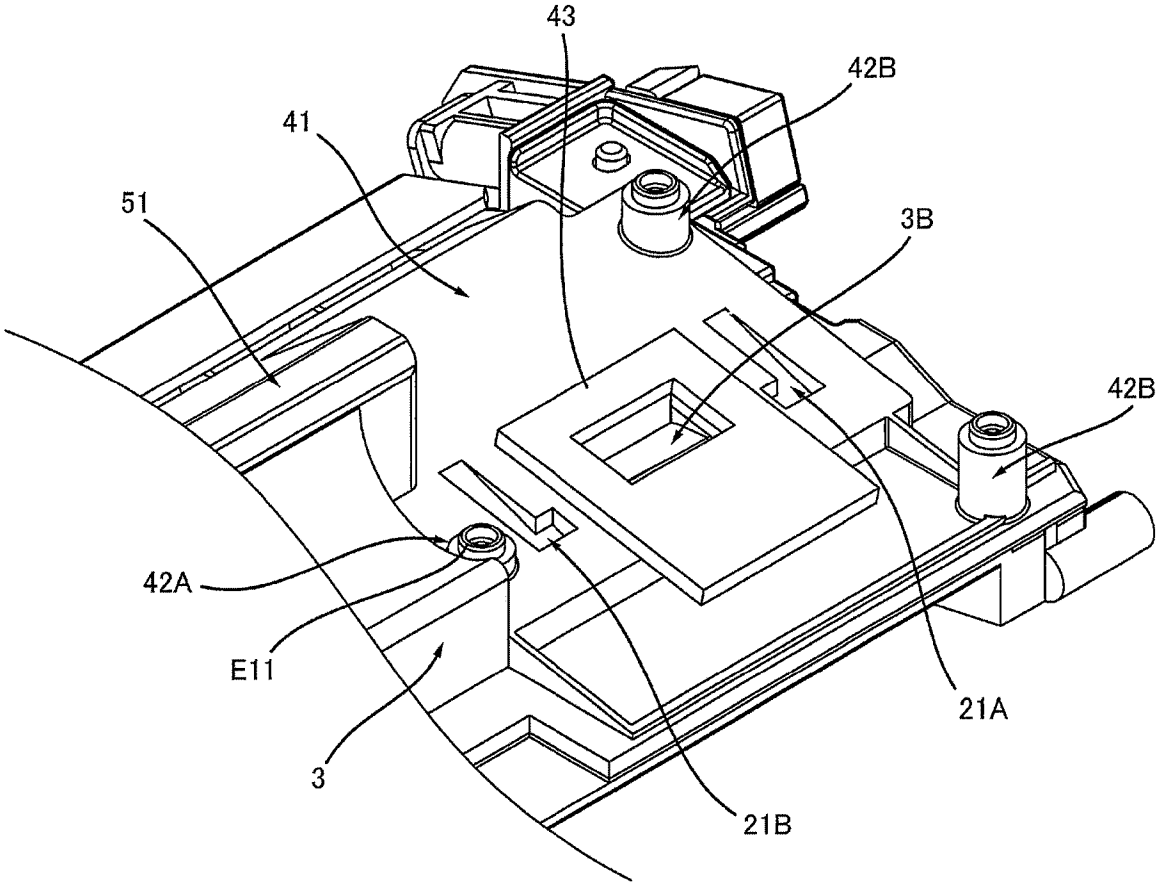
FIG. 6 is a perspective view of part of a housing of the developing apparatus shown in FIG. 1, from which the cover and the shutter are removed.

As shown in FIG. 5 and FIG. 6, an attachment part 41 of the housing 3 (to be described later) includes recesses 21A and 21B at positions facing the locking members 12A and 12B, respectively. The locking member 12A is received in the recess 21A in a case where the locking member 12A is bent in the cartridge-attachment direction, and the locking member 12B is received in the recess 21B in a case where the locking member 12A is bent in the cartridge-attachment direction. The locking members 12A and 12B move from the release positions back to the lock positions in a case where the main parts 18 of the locking members 12A and 12B are restored from their bent states to the original states.

2.3 Cover

As shown in FIG. 1, the cover 13 is attached to the attachment part 41 of the housing 3 (see FIG. 6) which is located at one end portion of the housing 3 in the first direction.

2.3.1 Cover Part

As shown in FIG. 3B and FIG. 4, the cover 13 includes a cover part 31 and a plurality of ribs 35 (see FIG. 3B). The cover 13 has the second opening 32. The cover 13 is attached with a seal member 33 (see FIG. 4).

Figure 13:
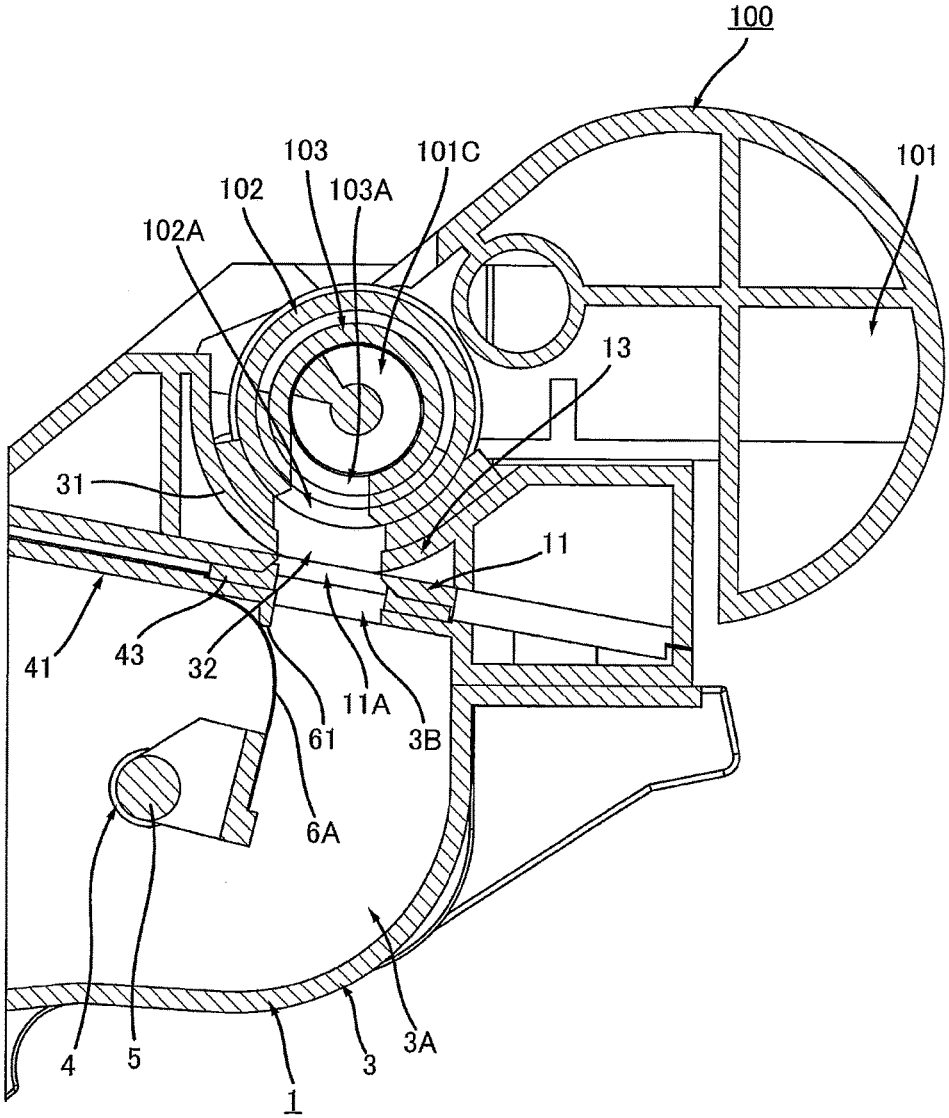
FIG. 13 is a cross-sectional view of the developing apparatus attached with the toner cartridge, corresponding to the cross-sectional view taken along the line D-D in FIG. 4, and shows a state where the toner cartridge is at the second position with respect to the developing apparatus.

The cover part 31 is for covering the shutter 11. As shown in FIG. 10 and FIG. 13, the cover part 31 is located at an opposite side of the locking members 12A and 12B with respect to the shutter 11 in the cartridge-attachment direction. That is, the cover 13 is located at an opposite side of the locking members 12A and 12B with respect to the shutter 11 in the cartridge-attachment direction. With this configuration, in a case where the locking members 12A and 12B abut against the shutter 11 in a direction parallel to the cartridge-attachment direction, the cover part 31 holds the shutter 11 to suppress generation of a gap between the shutter 11 and a seal member 43 provided to the housing 3 (to be described later, see FIG. 6). In addition, the cover part 31 receives the pressing force from the locking members 12A and 12B, thereby preventing the toner cartridge 100 from separating from the housing 3 of the developing apparatus 1. As shown in FIG. 3B and FIG. 4, the cover part 31 extends both in the first direction and the second direction. The length of the cover part 31 in the first direction is shorter than the length of the shutter 11 in the first direction. The outer surface of the cover part 31 is curved to fit the curved shape of an outer surface of a cover 102 provided to the toner cartridge 100 (to be described later, see FIG. 9).

The second opening 32 is located in the cover part 31. While the shutter 11 is at the open position, the second opening 32 of the cover 13 is in fluid communication with the first opening 3B of the housing 3 (see FIG. 13) through the shutter opening 11A. On the other hand, when the shutter 11 is at the closed position, the shutter opening 11A does not overlap the second opening 32, as a result of which the second opening 32 of the cover 13 does not communicate with the first opening 3B of the housing 3.

The seal member 33 is attached to an outer surface of the cover part 31. More specifically, the seal member 33 is provided at an edge of the second opening 32, and surrounds the circumference of the second opening 32. With this configuration, the seal member 33 serves to seal the gap between the toner cartridge 100 and the cover 13 in a case where the toner cartridge 100 is attached to the developing apparatus 1.

The ribs 35 are provided inside the cover 13. More specifically, the ribs 35 are provided inside the cover part 31. Each rib 35 extends in either the first or second direction. Those ribs 35 that extend in the first direction are arranged in the second direction with gaps being located between each two adjacent ribs 35 in the second direction. Those ribs 35 that extend in the second direction are arranged in the first direction with gaps being located between each two adjacent ribs 35 in the first direction. The ribs 35 extending in the first direction intersect with the ribs 35 extending in the second direction. As apparent from FIGS. 3A and 3B, the ribs 35 contact the shutter 11. With this configuration, the area at which the cover 13 contacts the shutter 11 is reduced, enabling the shutter 11 to move smoothly relative to the cover 13.

2.3.2 Third Opening

As shown in FIG. 4, the cover 13 has third openings 36A and 36B. The third opening 36A is located at an opposite side of the third opening 36B with respect to the cover part 31 in the first direction. The shutter 11 is located relative to the cover 13 such that the gear parts 17A and 17B of the shutter 11 are located at opposite sides from each other with respect to the cover part 31 in the first direction. The gear part 17A of the shutter 11 and the locking member 12A are exposed through the third opening 36A, and the gear part 17B of the shutter 11 and the locking member 12B are exposed through the third opening 36B. The cover part 31 has a guide surface S11 and a guide surface S12 which are arranged in the first direction. More specifically, the guide surface S114 is provided at one end of the cover part 31 in the first direction, while the guide surface S12 is provided at the other end of the cover part 31 in the first direction. Each of the guide surfaces S11 and S12 extend in the second direction. That is, each of the guide surfaces S11 and S12 extends in the shutter-moving direction M. The guide surface S11 faces the gear part 17A of the shutter 11 in the first direction and contact the gear part 17A. The guide surface S12 faces the gear part 17B of the shutter 11 in the first direction and contacts the gear part 17B. The guide surfaces S11 and S12 are for guiding movement of the shutter 11 by contacting the gear parts 17A and 17B, respectively.

2.3.3 Groove

Further, as shown in FIG. 1, the cover 13 includes a groove 37.

A protrusion 103B provided at the toner cartridge 100 (to be described later, see FIG. 9) is fitted in the groove 37 when the toner cartridge 100 is attached to the developing apparatus 1. The groove 37 extends in the cartridge-attachment direction, and has a width large enough to receive the protrusion 103B. The groove 37 serves to fix the toner cartridge 100 in position relative to the first opening 3B of the developing apparatus 1 when the protrusion 103B is fitted into the groove 37. More specifically, once the protrusion 103B is fitted in the groove 37, the shutter 103 of the toner cartridge 100 (see FIG. 9) is fixed in position relative to the developing apparatus 1, and becomes unable to rotate relative to the developing apparatus 1. In this way, an opening 103A of the toner cartridge 100 (to be described later) is fixed in position relative to the first opening 3B of the developing apparatus 1 as shown in FIG. 10. More specifically, the opening 103A of the toner cartridge 100 is fixed in position relative to the developing apparatus 1 such that at least portion of the opening 103A of the toner cartridge 100 overlaps the first opening 3B of the housing 3 when viewed in the cartridge-attachment direction.

2.4 Details of the Housing

The housing 3 of the developing apparatus 1 will be described below in detail.

2.4.1 Attachment Part, Seal Member and Boss

As shown in FIG. 6, the housing 3 includes the attachment part 41. The seal member 43 and at least one boss, including a first boss 42A and a plurality of (two, in this example) second bosses 42B, are attached to the housing 3.

The attachment part 41 is a portion of the housing 3, to which the cover 13 is attached. The attachment part 41 is located at the one end portion of the housing 3 in the first direction. The attachment part 41 extends both in the first and second directions. The first opening 3B is located at the attachment part 41. As shown in FIG. 10, while the shutter 11 remains at the closed position, no portion of the first opening 3B overlaps with the shutter opening 11A when viewed in the cartridge-attachment direction. As shown in FIG. 13, while the shutter 11 remains at the open position, at least part of the first opening 3B overlaps with the shutter opening 11A as viewed in the cartridge-attachment direction. Hence, the developing apparatus 1 can receive toner through the second opening 32 and the shutter opening 11A, while the toner cartridge 100 remains attached to the developing apparatus 1 and the shutter 11 remains at the open position.

The seal member 43 is for sealing the gap between the housing 3 and the shutter 11. As shown in FIG. 6 and FIG. 13, the seal member 43 is provided at an edge of the first opening 3B. The seal member 43 surrounds the circumference of the first opening 3B. The seal member 43 is located between the housing 3 and the shutter 11 in the cartridge-attachment direction. The seal member 43 contacts both of the housing 3 and the shutter 11 in the cartridge-attachment direction. More specifically, the seal member 43 is attached, with adhesive, to the outer surface of the attachment part 41 in the cartridge-attachment direction such that the seal member 43 contacts the shutter 11. The shutter 11 is capable of sliding on the seal member 43 in the second direction.

Figure 7:
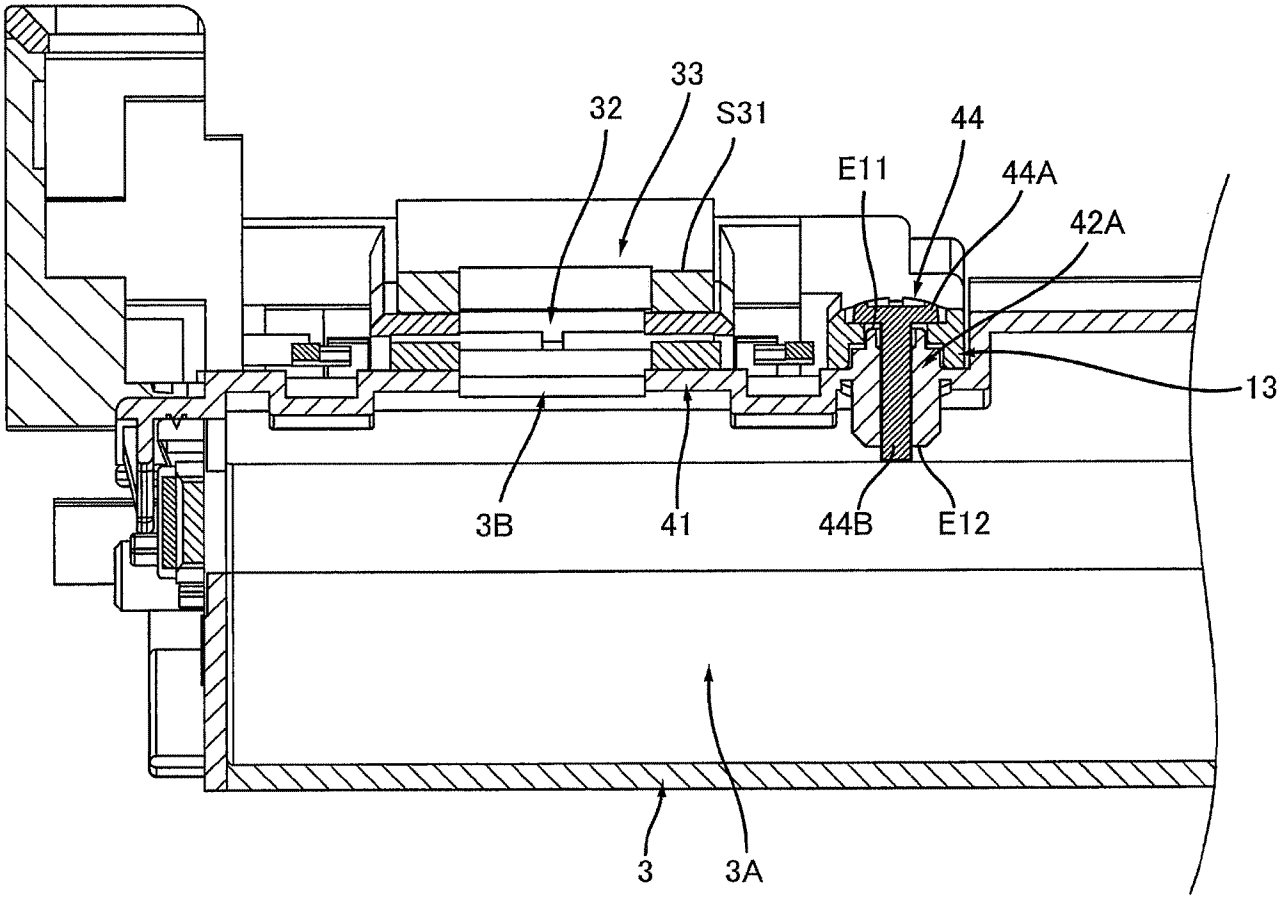
FIG. 7 is a sectional view of part of the developing apparatus taken along a line B-B in FIG. 4.

As shown in FIG. 4 and FIG. 6, the first boss 42A is located at an opposite side of the groove 37 with respect to the first opening 3B in the first direction. The first boss 42A is located at an opposite side of the first opening 3B with respect to the locking member 12B in the first direction. The first boss 42A is located at a position spaced apart from the first opening 3B in the first direction. The first boss 42A extends in the cartridge-attachment direction. In other words, the first boss 42A extends in a direction parallel to a direction in which the groove 37 extends. The first boss 42A is in a hollow cylindrical shape extending in the cartridge-attachment direction. As shown in FIG. 7, the first boss 42A has one end E11 and the other end E12 opposite to each other in the cartridge-attachment direction. The one end E11 of the first boss 42A is located at an opposite side of the internal space 3A of the housing 3 with respect to the attachment part 41 in the cartridge-attachment direction. That is, the first boss 42A protrudes or projects from the outer surface of the attachment part 41 in a direction that is parallel to the cartridge-attachment direction and that is directed away from the internal space 3A of the housing 3. In other words, a direction that is parallel to the cartridge-attachment direction and that is directed away from the internal space 3A of the housing 3 is a first-boss-protruding direction, in which the first boss 42A protrudes. The end E11 of the first boss 42A is a distal end of the first boss 42A that is defined in the first-boss-protruding direction. The end E11 of the first boss 42A is located closer to the attachment part 41 than an outer surface S31 of the seal member 33 to the attachment part 41 in the first-boss-protruding direction. The other end E12 of the first boss 42A is located in the internal space 3A of the housing 3. Thus, at least portion of the first boss 42A is located in the internal space 3A of the housing 3. As shown in FIG. 2, a distance D1, defined between the second axis A2 and the other end E12 of the first boss 42A, is longer than a distance D2, defined between the second axis A2 and a portion of an inner surface S41 of the housing 3 that faces the internal space 3A and that is at an opposite side of the first opening 3B with respect to the second axis A2.

As shown in FIG. 4 and FIG. 6, each of the second bosses 42B is located between the first opening 3B and the groove 37 in the first direction. Each of the second bosses 42B is located at an opposite side of the first opening 3B with respect to the locking member 12A in the first direction. Each of the second bosses 42B is located at a position spaced apart from the first opening 3B in the first direction. The second bosses 42B are arranged in the second direction with gaps being located therebetween. The first opening 3B is located at a position between the second bosses 42B in the second direction. Each of the second bosses 42B extends in the cartridge-attachment direction. Each of the second bosses 42B is in a hollow cylindrical shape extending in the cartridge-attachment direction. Each of the second bosses 42B protrudes or projects from the outer surface of the attachment part 41 in a direction that is parallel to the cartridge-attachment direction and is directed away from the internal space 3A of the housing 3.

As shown in FIG. 3B, the cover 13 has a plurality of holes. In this example, the cover 13 is has a first through-hole 38A and two second through-holes 38B. The first through-hole 38A extends in a direction parallel to the direction, in which the first boss 42A extends. The second through-holes 38B extend in a direction parallel to the direction, in which the second bosses 42B extend. The end E11 of the first boss 42A is inserted into the first through-hole 38A of the cover 13. Each of the two second bosses 42B is inserted into a corresponding one of the two second through-holes 38B of the cover 13. By inserting each of the first and second bosses 42A and 42B into the corresponding one of the first and second through-holes 38A and 38B, the cover 13 is fixed to the attachment part 41 in both of the first and second directions. As shown in FIG. 4, a screw 44 is attached into the first boss 42A, while the end E11 of the first boss 42A remains inserted in the first through-hole 38A of the cover 13. Further, a screw 44 is attached in each of the second bosses 42B that remains inserted in the corresponding one of the second through-holes 38B of the cover 13. More specifically, as shown in FIG. 7, each screw 44 has a head part 44A and a shaft part 44B. The head part 44A is located at an opposite side of the attachment part 41 with respect to part of the cover 13 in the cartridge-attachment direction. The head part 44A confronts, in the cartridge-attachment direction, the part of the cover 13 that is interposed between the head part 44A and the attachment part 41. In such a manner, the cover 13 is fixedly secured to the attachment part 41 by the plurality of screws 44. In the state where the screw 44 is attached in the first boss 42A, the shaft part 44B of the screw 44 penetrates the first boss 42A.

2.4.2 Protrusion

As shown in FIG. 1 and FIG. 2, the housing 3 further includes a protrusion 51.

The protrusion 51 and the attachment part 41 (see FIG. 6) are arranged adjacent to each other in the first direction. The protrusion 51 protrudes from the housing 3 in a direction that is parallel to the cartridge-attachment direction and that is directed away from the internal space 3A of the housing 3. The protrusion 51 protrudes away from the internal space 3A of the housing 3 in the direction parallel to the cartridge-attachment direction such that part of the protrusion 51 that is farthest from the internal space 3A of the housing 3 is farther away from the internal space 3A of the housing 3 relative to the attachment part 41 is from the internal space 3A of the housing 3. The protrusion 51 extends in the first direction. In the state where the cover 13 remains attached to the attachment part 41, the protrusion 51 confronts the cover 13 in the first direction and contacts the cover 13. The protrusion 51 has an internal space 51A that is in fluid communication with the internal space 3A of the housing 3. The protrusion 51 has an inner surface S51 facing the internal space 51A of the protrusion 51. A distance, defined between the second axis A2 and the inner surface S51 of the protrusion 51 in the cartridge-attachment direction, is larger than a distance, defined between the second axis A2 and the attachment part 41 in the cartridge-attachment direction.

2.4.3 Agitator and Protrusion

Figure 8:
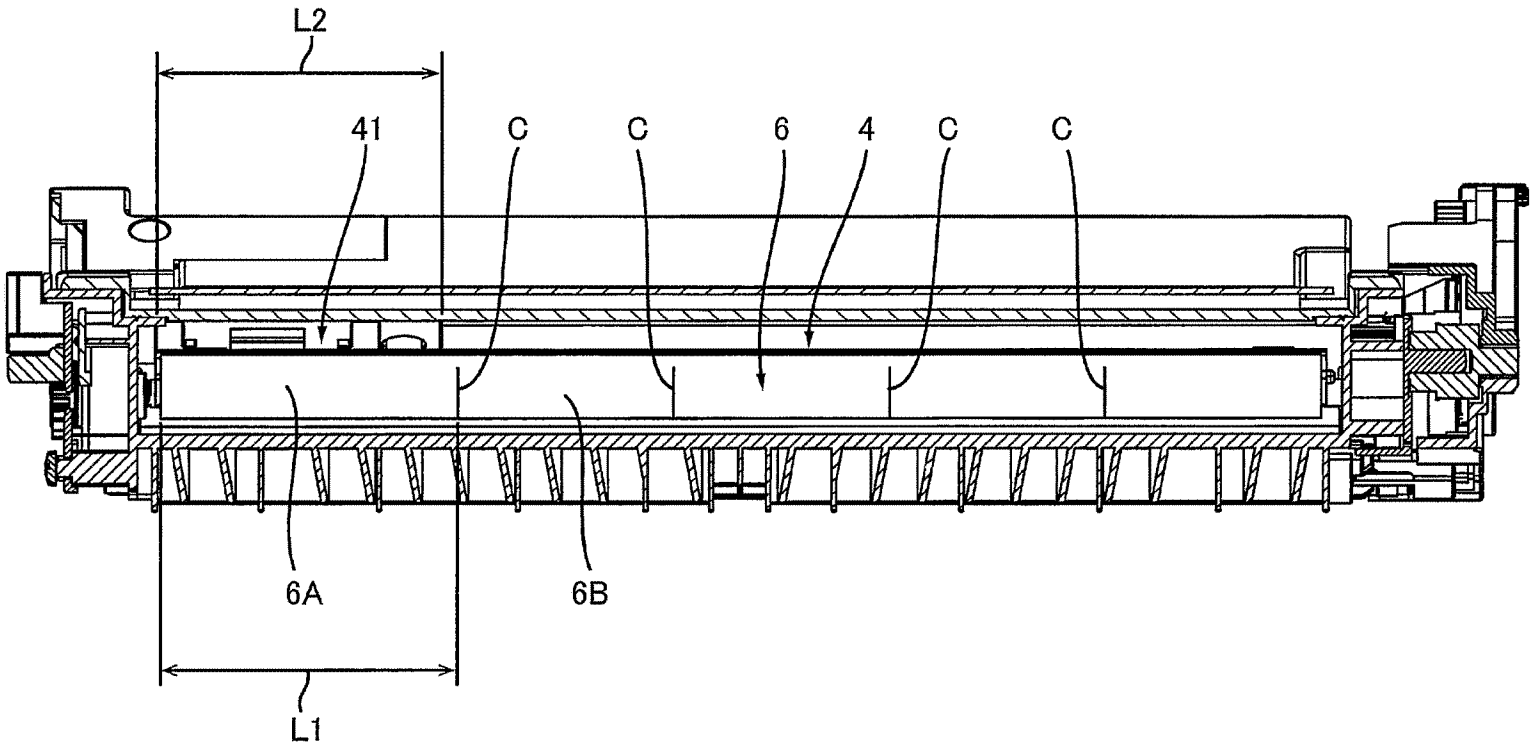
FIG. 8 is a sectional view of the developing apparatus, corresponding to a sectional view taken along a line C-C in FIG. 4.

As shown in FIG. 8, the blade 6 of the agitator 4 extends in the first direction. The blade 6 of the agitator 4 has one end and the other end in the first direction. The other end is spaced apart from the one end in the first direction. The blade 6 of the agitator 4 has a plurality of notches C with prescribed intervals in the first direction. The blade 6 is divided by the plurality of notches into a plurality blade parts, including a first blade part 6A and a second blade part 6B. The blade parts, including the first and second blade parts 6A and 6B, are capable of rotating together with the agitator shaft 5 (see FIG. 2). The first blade part 6A and the second blade part 6B are arranged adjacent to each other in the first direction, with a notch C being formed between the second blade part 6B and the first blade part 6A. The first and second blade parts 6A and 6B are spaced apart from each other by a gap corresponding to the notch C. The first blade part 6A is located at the one end of the blade 6 in the first direction. Each of the first and second blade parts 6A and 6B extends in the first direction.

The first blade part 6A is capable of contacting an inner surface of the attachment part 41 that faces the internal space 3A of the housing 3. A length L1 of the first blade part 6A in the first direction is greater than or equal to a length L2 of the attachment part 41 in the first direction. More specifically, the length L1 of the first blade part 6A in the first direction is longer than or equal to the length L2 of the attachment part 41 in the first direction, and shorter than or equal to 1.5 times as long as the length L2 of the attachment part 41 in the first direction. That is, the lengths L1 and L2 satisfy the following relationship: $L2 \leq L1 \leq 1.5 \times L2$. Preferably, the length L1 of the first blade part 6A in the first direction is longer than or equal to the length L2 of the attachment part 41 in the first direction, and shorter than or equal to 1.2 times as long as the length L2 of the attachment part 41 in the first direction. That is, it is preferable that the lengths L1 and L2 satisfy the following relationship: $L2 \leq L1 \leq 1.2 \times L2$. These relationships in sizes between the first blade part 6A and the attachment part 41 can suppress the first blade part 6A from being twisted in a case where the first blade part 6A contacts the inner surface of the attachment part 41.

As shown in FIG. 13, the housing 3 further includes a protrusion 61.

The protrusion 61 is configured such that the first blade part 6A contacts the protrusion 61 when the first blade part 6A passes through a gap between the first opening 3B and the agitator shaft 5 in the internal space 3A of the housing 3. The protrusion 61 protrudes into the internal space 3A of the housing 3 from an upstream edge of the first opening 3B in a direction, in which the first blade part 6A moves through a gap between the attachment part 41 and the agitator shaft 5. With this configuration, in a case where the first blade part 6A passes through the gap between the attachment part 41 and the agitator shaft 5, the first blade part 6A contacts the protrusion 61, whereupon the first blade part 6A is bent. While maintaining the bent state, the first blade part 6A passes through the gap between the first opening 3B and the agitator shaft 5. This suppresses the first blade part 6A from pushing toner from the internal space 3A of the housing 3 toward outside of the housing 3 through the first opening 3B, while the first blade part 6A is passing through the gap between the first opening 3B and the agitator shaft 5.

3. Outline of the Toner Cartridge

Next, the toner cartridge 100 will be briefly described with reference to FIG. 9.

The toner cartridge 100 is configured to accommodate toner therein. The toner cartridge 100 includes: a housing 101, a cover 102, the shutter 103, the gear parts 104A and 104B, and the protrusions 105A and 105B.

3.1 Housing

The housing 101 is for accommodating toner therein. The housing 101 is elongated in a prescribed direction. The housing 101 includes a first toner-accommodating part 101A and a second toner-accommodating part 101B.

The first toner-accommodating part 101A extends in the prescribed direction. In this example, the first toner-accommodating part 101A is in a hollow cylindrical shape extending in the prescribed direction. The first toner-accommodating part 101A has an internal space extending in the prescribed direction. The first toner-accommodating part 101A is capable of accommodating toner in the internal space of the first toner-accommodating part 101A. An agitator (not shown) is provided in the first toner-accommodating part 101A. The agitator agitates toner in the first toner-accommodating part 101A and transports toner to the second toner-accommodating part 101B.

The second toner-accommodating part 101B is located at one side of the first toner-accommodating part 101A in a radial direction of the first toner-accommodating part 101A. In other words, the first and second toner-accommodating parts 101A and 101B are arranged adjacent to each other in the radial direction of the first toner-accommodating part 101A. The second toner-accommodating part 101B extends in the prescribed direction. In this example, the second toner-accommodating part 101B is in a hollow cylindrical shape extending in the prescribed direction. The second toner-accommodating part 101B has an outer diameter smaller than an outer diameter of the first toner-accommodating part 101A. The second toner-accommodating part 101B has an internal space extending in the prescribed direction. The second toner-accommodating part 101B is connected to the first toner-accommodating part 101A such that the internal space of the second toner-accommodating part 101B is in fluid communication with the internal space of the first toner-accommodating part 101A. An auger 101C (see FIG. 10) is provided in the second toner-accommodating part 101B. The auger 101C transports toner in the prescribed direction in the inside of the second toner-accommodating part 101B.

3.2 Cover

The cover 102 is for covering the shutter 103. The cover 102 is attached to one end of the second toner-accommodating part 101B in the prescribed direction such that the cover 102 is located adjacent to the first toner-accommodating part 101A in the radial direction of the first toner-accommodating part 101A. The cover 102 extends in the prescribed direction. In this example, the cover 102 is in a hollow cylindrical shape extending in the prescribed direction. The cover 102 includes the gear parts 104A and 104B and the protrusions 105A and 105B. The cover 102 has an opening 102A.

The gear parts 104A and 104B are for moving the shutter 11 of the developing apparatus 1 when the toner cartridge 100 is pivotally moved with respect to the developing apparatus 1 as shown in FIG. 12. The gear parts 104A and 104B are spaced apart from each other in the prescribed direction. Each of the gear parts 104A and 104B includes a plurality of gear teeth which are arranged in a direction, in which the cover 102 rotates relative to the shutter 103.

The protrusions 105A and 105B are for setting, to the release positions, the locking members 12A and 12B of the developing apparatus 1 (see FIGS. 1 and 11) in a case where the toner cartridge 100 remains attached to the developing apparatus 1 and the toner cartridge 100 is at the first position with respect to the developing apparatus 1. The protrusion 105A is located at an opposite side of the gear part 104B with respect to the gear part 104A in the prescribed direction. The protrusion 105B is located at an opposite side of the gear part 104A with respect to the gear part 104B in the prescribed direction. The protrusions 105A and 105B are located at an opposite side of the first toner-accommodating part 101A with respect to the second toner-accommodating part 101B and cover 102 in the radial direction of the first accommodating part 101A, and protrude outwardly in the radial direction of the first accommodating part 101A. In other words, the toner cartridge 100 includes the protrusions 105A and 105B such that when viewed in the prescribed direction, the first toner-accommodating part 101A, the second toner-accommodating part 101B or cover 102, and the protrusion 105A or 105B are arranged in this order in the radial direction of the first accommodating part 101A, and the protrusions 105A and 105B protrude further away from the first and second toner-accommodating parts 101A and 101B and cover 102 in the radial direction of the first accommodating part 101A.

The opening 102A is formed in the cover 102 at a position between the gear parts 104A and 104B in the prescribed direction.

3.3 Shutter

The shutter 103 is for opening and closing the opening 102A of the cover 102. The shutter 103 is attached to the one end of the second toner-accommodating part 101B in the prescribed direction, and is located in the internal space of the cover 102. The shutter 103 extends in the prescribed direction. In this example, the shutter 103 is in a hollow cylindrical shape extending in the prescribed direction. The internal space of the shutter 103 is in fluid communication with the internal space of the second toner-accommodating part 101B. The shutter 103 is movable relative to the cover 102 and the housing 101 between an open position (see FIG. 13), at which the shutter 103 opens the opening 102A of the cover 102, and a closed position (see FIG. 10), at which the shutter 103 closes the opening 102A. More specifically, the shutter 103 has the opening 103A (see FIG. 10). In a case where the shutter 103 is at the open position with respect to the cover 102, at least portion of the opening 103A of the shutter 103 overlaps with the opening 102A of the cover 102, thereby allowing toner to be discharged out of the internal space of the shutter 103 through the openings 103A and 102A. On the other hand, in a case where the shutter 103 is at the closed position with respect to the cover 102, no portion of the opening 103A overlaps with the opening 102A of the cover 102, thereby preventing toner from being discharged out of the internal space of the shutter 103 through the openings 103A and 102A.

The shutter 13 includes the protrusion 103B. The protrusion 103B is used for fixing the shutter 103 of the toner cartridge 100 in position relative to the developing apparatus 1 in a case where the toner cartridge 100 is attached to the developing apparatus 1. The protrusion 103B is located at an opposite side of the second toner-accommodating part 101B with respect to the cover 102 in the prescribed direction. The protrusion 103B protrudes from the shutter 103 in the prescribed direction. With this configuration, the protrusion 103B is rotatable together with the shutter 103 relative to the cover 102. In a case where the toner cartridge 100 is attached to the developing apparatus 1, the protrusion 103B is fitted into the groove 37 of the developing apparatus 1 (see FIG. 1). Once the toner cartridge 100 is attached to the developing apparatus 1 with the protrusion 103B being fitted in the groove 37, the shutter 103 is fixed in position relative to the developing apparatus 1, thereby preventing the shutter 103 from rotating relative to the developing apparatus 1.

4. Attaching and Detaching the Toner Cartridge to and from the Developing Apparatus Next will be described with reference to FIG. 10 to FIG. 13 how to attach the toner cartridge 100 to the developing apparatus 1 and how to detach the toner cartridge 100 from the developing apparatus 1.

4.1 Attaching the Toner Cartridge to the Developing Apparatus

In order to attach the toner cartridge 100 to the developing apparatus 1, a user first mounts the toner cartridge 100 onto the developing apparatus 1 as shown in FIG. 10. As a result, the toner cartridge 100 is disposed at the first position with respect to the developing apparatus 1. At this time, the protrusion 103B of the toner cartridge 100 (see FIG. 9) is fitted into the groove 37 of the developing apparatus 1 (see FIG. 1). As a result, the shutter 103 is fixed in position with respect to the developing apparatus 1 such that the shutter 103 becomes unable to rotate relative to the developing apparatus 1. At this time, the shutter 103 is disposed at the closed position with respect to the cover 102, thereby closing the opening 102A.

Figure 11:
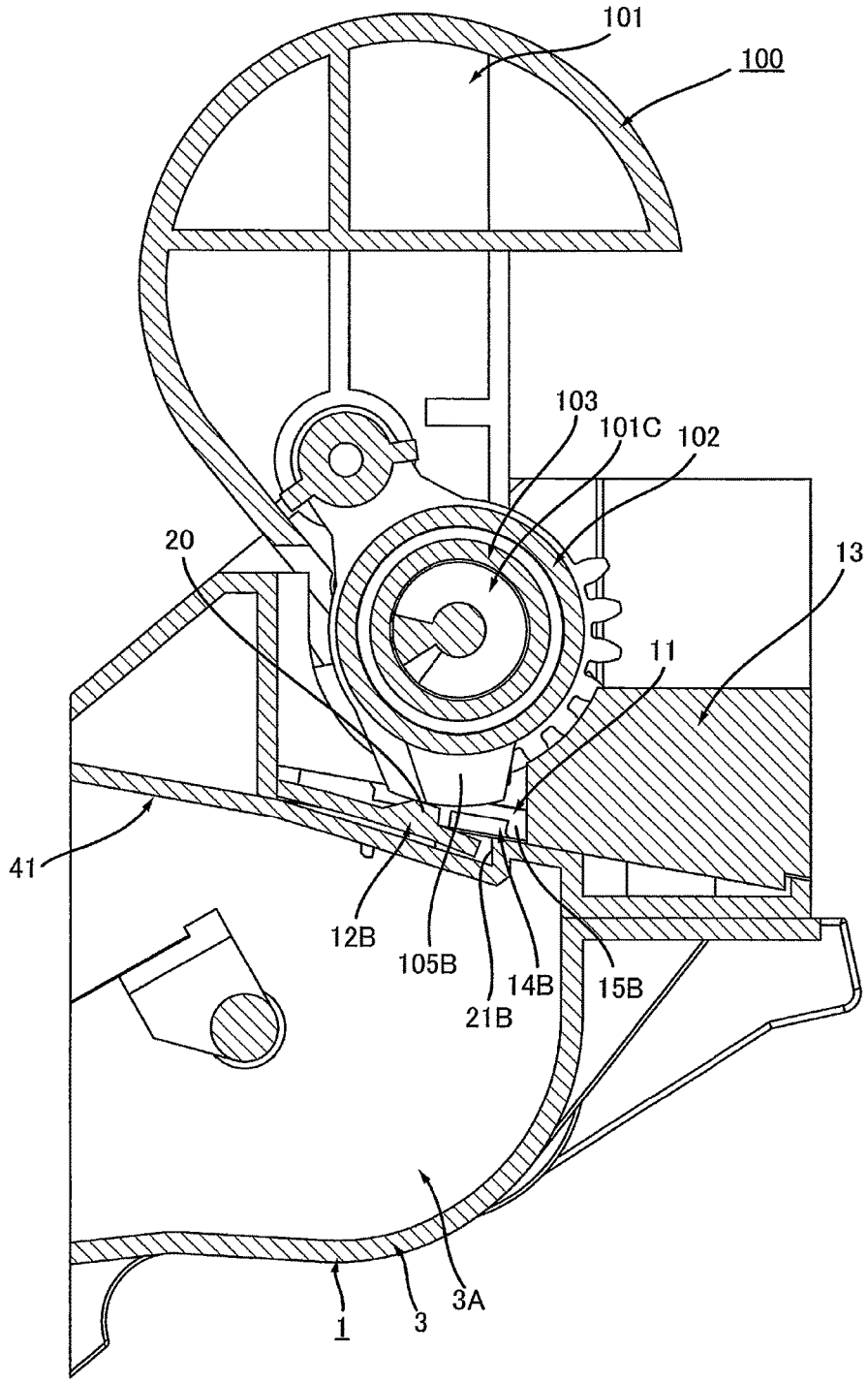
FIG. 11 is a cross-sectional view of the developing apparatus attached with the toner cartridge, corresponding to the cross-sectional view taken along the line A-A in FIG. 4, and shows the state where the toner cartridge is at the first position with respect to the developing apparatus.

Also at this time, the shutter 11 of the developing apparatus 1 is disposed at the closed position as shown in FIG. 10, closing the first opening 3B. As shown in FIG. 11, the protrusion 105B of the toner cartridge 100 contacts the second protrusion 20 of the locking member 12B, and the protrusion 105A of the toner cartridge 100 contacts the second protrusion 20 of the locking member 12A. As a result, the locking members 12A and 12B move from the lock positions to the release positions. Hence, the shutter 11 in the developing apparatus 1 becomes capable of moving from the closed position to the open position.

Next, as shown in FIG. 12, the user pivotally moves the toner cartridge 100 from the first position to the second position relative to the developing apparatus 1. As a result, the housing 101 and the cover 102 of the toner cartridge 100 rotate relative to the shutter 103, which is now fixed in position relative to the developing apparatus 1. Thus, the toner cartridge 100 is pivotally moved from the first position to the second position relative to the developing apparatus 1. As a result, the gear teeth in the gear part 104A of the toner cartridge 100 are brought into engagement with the gear teeth in the gear part 17A of the shutter 11 in succession, and the gear teeth in the gear part 104B of the toner cartridge 100 are brought into engagement with the gear teeth in the gear part 17B of the shutter 11 in succession. As a result, the shutter 11 moves from the closed position to the open position.

As shown in FIG. 13, in a case where the toner cartridge 100 becomes located at the second position with respect to the developing apparatus 1, the shutter 11 becomes located at the open position. As a result, at least portion of the shutter opening 11A of the shutter 11 overlaps with both of the first opening 3B of the housing 3 and the second opening 32 of the cover 13. The developing apparatus 1 becomes capable of receiving toner from the toner cartridge 100 through the second opening 32, shutter opening 11A, and first opening 3B.

At this time, the shutter 103 of the toner cartridge 100 becomes located at the open position relative to the cover 102. As a result, at least portion of the opening 103A of the shutter 103 overlaps with the opening 102A of the cover 102. The toner cartridge 100 becomes capable of supplying toner through the opening 103A of the shutter 103 and the opening 102A of the cover 102. At this time, attachment of the toner cartridge 100 to the developing apparatus 1 is completed.

4.2 Detaching the Toner Cartridge from the Developing Apparatus

In order to detach the toner cartridge 100 from the developing apparatus 1, the user pivotally moves the toner cartridge 100 from the second position to the first position relative to the developing apparatus 1.

As a result, as shown in FIG. 12, the shutter 11 of the developing apparatus 1 moves from the open position to the closed position due to engagement between the gear part 104B and the gear part 17B and engagement between the gear part 104A and the gear part 17A.

As shown in FIG. 10 and FIG. 11, in a case where the toner cartridge 100 becomes located at the first position with respect to the developing apparatus 1, the shutter 11 becomes located at the closed position. At this time, the protrusions 105A and 105B of the toner cartridge 100 are in contact with the second protrusions 20 of the locking member 12A and 12B. Accordingly, the locking members 12A and 12B become located at the release positions. Also at this time, the shutter 103 of the toner cartridge 100 becomes located at the closed position relative to the cover 102, closing the opening 102A of the cover 102.

Next, the user pulls the toner cartridge 100 from the developing apparatus 1. As a result, as shown in FIG. 5, the locking members 12A and 12B move from the release positions back to the lock positions, at which the locking members 12A and 12B lock the shutter 11 at the closed position. At this time, detachment of the toner cartridge 100 from the developing apparatus 1 is completed.

5. Transport of Toner from the Toner Cartridge to the Developing Apparatus

As shown in FIG. 13, while the toner cartridge 100 remains attached to the developing apparatus 1 and remains at the second position relative to the developing apparatus 1, when the image forming apparatus performs an image forming process, the auger 101C and the agitator (not shown) located in the toner cartridge 100 are rotated by the driving force applied from the image forming apparatus. Further, the agitator 4 and developing roller 2 provided in the developing apparatus 1 (see FIG. 2) are rotated by the driving force applied from the image forming apparatus.

In the toner cartridge 100, as the agitator and the auger 101C are rotated, toner is transported to the opening 103A of the shutter 103, and is supplied outside the toner cartridge 100 through the opening 103A and the opening 102A of the cover 102. Toner supplied outside the toner cartridge 100 is received in the internal space 3A of the developing apparatus 1 through the opening 32 of the cover 13, the shutter opening 11A of the shutter 11, and the first opening 3B of the housing 3. Thus, transport of toner from the toner cartridge 100 to the developing apparatus 1 is completed. In the developing apparatus 1, toner received in the internal space 3A is supplied to the developing roller 2 as the agitator 4 rotates, and is then supplied to the photosensitive body as the developing roller 2 rotates.

6. Advantages

As shown in FIG. 3A, in the developing apparatus 1, the cover 13 is located at an opposite side of the locking members 12A and 12B with respect to the shutter 11 in the cartridge-attachment direction, in which the toner cartridge 100 is attached to the developing apparatus 1. In other words, the cover 13 is located relative to the shutter 11 and the locking members 12A and 12B such that the shutter 11 is interposed between the cover 13 and the locking members 12A and 12B in the cartridge-attachment direction.

Therefore, the cover 13 is capable of receiving the pressing force applied from the locking members 12A and 12B when the locking members 12A and 12B abut against the shutter 11.

Hence, even in the state where the locking members 12A and 12B are abutted against the shutter 11, no gap is generated between the shutter 11 and the housing 3 of the developing apparatus 1, and no gap is generated between the first opening 3B of the developing apparatus 1 and the opening 103A of the toner cartridge 100.

Further, the shutter 11 is capable of being moved between the closed position (see FIG. 13) and the open position (see FIG. 11), while being held by the cover 13. Accordingly, the shutter 11 can be smoothly opened and closed, while preventing toner from leaking.

While the description has been made in detail with reference to specific embodiments thereof, it would be apparent to those skilled in the art that various changes and modifications may be made therein without departing from the spirit and scope of the above described aspect.

What is claimed is:

1. A developing apparatus, to which a toner cartridge is attachable, the developing apparatus comprising:

a developing roller;

a housing configured to accommodate toner therein, the housing having a first opening;

a shutter movable relative to the housing between an open position, at which the shutter opens the first opening, and a closed position, at which the shutter closes the first opening;

a lock lever movable relative to the housing between a lock position, at which the lock lever locks the shutter in a case where the shutter is at the closed position, and a release position, at which the lock lever releases the shutter in a case where the shutter is at the closed position, the lock lever being movable to the release position from the lock position in response to movement of attaching the toner cartridge to the developing apparatus, the lock lever being movable to the lock position from the release position in response to movement of detaching the toner cartridge to the developing apparatus; and a cover covering at least part of the shutter, the cover attached to the housing, wherein the lock lever abuts against the shutter in a direction toward the cover in a case where the shutter is positioned at the open position, and wherein the cover holds the shutter in a case where the shutter is positioned at the open position.

2. The developing apparatus according to claim 1, wherein the lock lever abuts against the shutter in the direction toward the cover when the shutter moves between the open position and the closed position, and wherein the cover holds the shutter in a case where the shutter moves between the open position and the closed position.

3. The developing apparatus according to claim 1, wherein the shutter is movable relative to the cover between the open position and the closed position in a case where the lock lever is at the release position.

4. The developing apparatus according to claim 1, wherein the cover has a second opening that is in communication with the first opening in a case where the shutter is at the open position.

5. The developing apparatus according to claim 1, wherein the developing roller is rotatable about a first axis extending in a first direction, and wherein the shutter is movable in a second direction intersecting with the first direction.

6. The developing apparatus according to claim 5, wherein the cover includes a plurality of ribs extending in the first direction, the ribs contacting the shutter.

7. The developing apparatus according to claim 5, wherein the shutter is positioned between the housing and the cover in a third direction intersecting the first direction and the second direction.

8. The developing apparatus according to claim 7, wherein the toner cartridge is attachable to the developing apparatus in the third direction.

9. The developing apparatus according to claim 7, wherein the cover includes a groove into which a protrusion of the toner cartridge is fitted to fix the toner cartridge in position with respect to the first opening in a case where the toner cartridge is attached to the developing apparatus.

10. The developing apparatus according to claim 9, wherein the groove extends in the third direction.

11. The developing apparatus according to claim 7, wherein the lock lever abuts against the shutter toward the cover in the third direction in a case where the shutter is positioned at the open position.

12. The developing apparatus according to claim 7, wherein the shutter has a first outer surface and a second outer surface, the first outer surface faces the housing in the third direction, the second outer surface faces the cover in the third direction, and wherein the lock lever abuts against the first outer surface of the shutter toward the cover in the third direction in a case where the shutter is at the open position.

13. The developing apparatus according to claim 7, wherein at least part of the lock lever is positioned between the housing and the shutter in the third direction.

14. The developing apparatus according to claim 7, wherein the shutter includes a locking groove, and wherein the lock lever includes:

a main part extending in the second direction;

a first protrusion protruding from the main part in the first direction, the first protrusion being fitted in the locking groove in a case where the lock lever is at the lock position; and a second protrusion protruding from the main part in the third direction, the second protrusion configured to be in contact with the toner cartridge in a case where the toner cartridge is attached to the developing apparatus.

15. The developing apparatus according to claim 14, wherein the first protrusion is configured to abut against the shutter toward the cover in the third direction in a case where the shutter is positioned at the open position.

16. The developing apparatus according to claim 14, wherein the first protrusion is positioned between the housing and the shutter in the third direction.

17. The developing apparatus according to claim 7, wherein the housing includes:

an attachment part to which the cover is attached, the first opening being positioned at the attachment part; and a first boss being spaced apart from the first opening in the first direction, the first boss protruding from the attachment part in the third direction, and wherein the cover has a first hole into which the first boss is inserted.

18. The developing apparatus according to claim 17, wherein the first boss is positioned in an internal space of the housing.

19. The developing apparatus according to claim 17, wherein the housing includes a second boss spaced apart from the first opening in the first direction, the first opening positioned between the first boss and the second boss in the first direction, the second boss protruding from the attachment part in the third direction, and wherein the cover has a second hole into which the second boss is inserted.

20. The developing apparatus according to claim 7, wherein the cover has a second opening that is in communication with the first opening in a case where the shutter is at the open position, and wherein the cover includes a seal member positioned between the toner cartridge and the cover in the third direction in a case where the toner cartridge is attached to the developing apparatus, the seal member surrounding a circumference of the second opening.

* * * * *